United States Patent [19]

Masera

[11] Patent Number: 4,819,888

[45] Date of Patent: Apr. 11, 1989

[54] SUPPORT FOR WINDING PACKAGES OF WIRE

[75] Inventor: Ercole Masera, Roveredo in Piano, Italy

[73] Assignee: Ferriere Nord Spa, Osoppo, Italy

[21] Appl. No.: 8,552

[22] Filed: Jan. 29, 1987

[30] Foreign Application Priority Data

Feb. 6, 1986 [IT] Italy ..... 83311 A/86

[51] Int. Cl.[4] ..... B65H 75/20

[52] U.S. Cl. ..... 242/77.2

[58] Field of Search ..... 242/77.2, 77, 129, 118.4, 242/118.7, 118.8

[56] References Cited

U.S. PATENT DOCUMENTS

| | | | |
|---|---|---|---|
| 1,020,079 | 3/1912 | Broden et al. | 242/77.2 |
| 1,862,199 | 6/1928 | Schane | 242/77.2 |
| 1,932,059 | 10/1933 | White | 242/77.2 |
| 2,080,355 | 12/1934 | Geer | 242/77.2 |
| 3,503,569 | 3/1970 | Gildart | 242/77.2 |
| 4,089,485 | 5/1978 | Van de Loock | 242/77.2 |
| 4,570,871 | 2/1986 | Compagnucci | 242/77.2 |
| 4,679,746 | 7/1987 | Compagnucci et al. . | |

*Primary Examiner*—Stuart S. Levy
*Assistant Examiner*—Steven M. duBois
*Attorney, Agent, or Firm*—Wegner & Bretschneider

[57] ABSTRACT

A support for winding packages of wire, such as welding wire, copper wire, tubular elements, steel wire, etc., such support comprising two side members (10) and spacers (12) on which a filiform element is wound, such side members (10) having their outer face substantially flat and each side member comprising a hub (13) to cooperate directly with a winding machine and with a usage machine, each side member (10) consisting of at least two elements (14) crossed over each other and interconnected at a connection point (15) so as to form at least part of the arms (11–111) of a cross.

11 Claims, 3 Drawing Sheets

SUPPORT FOR WINDING PACKAGES OF WIRE

This invention concerns a support for winding packages of wire. To be more exact, the invention concerns a support for the winding of wire, whether such wire be copper wire, welding wire or any other filiform element with a solid or hollow body, such as a pipe or other article.

The invention concerns in particular the supports for the winding of packages of wire by precision winding machines, such supports being suitable for being boxed in paper or cardboard containers and then palletized.

Supports made of metallic wire for the winding of wire packages have been known for some time now.

The present applicant has himself disclosed in the past various embodiments made of a basic element which, when coupled with other elements, forms a side member of a support. Such basic element includes a central angled portion superimposed on a coordinated angled portion of an identical element located alongside such first element so as to form the side member of the support or reel.

Such embodiment offers considerable advantages such as low weight, flat side surfaces, enough rigidity, flexibility, the ability to be employed on automatic winding machines, a preformed central hub, and so on.

However, it possesses certain features which require it to be carefully handled, since the connection of one element to another is obtained by welding. This means that the support itself has to be carefully examined both during its manufacture and thereafter during handling and storage so as to ensure that any unsatisfactory welds or impacts, even occasional impacts against its side members, do not cause separations of the elements by breakages of the welds and thus make it substantially impossible to use the support and any wire wound onto it.

Moreover, winding operations carried out with tension of the wire being wound may lead to breakages at the areas of connection of the basic elements where such connections have not been performed properly.

FR-A-445.975 discloses a support the side members of which consist of two elongate rings resting on each other so as to form a cross. This system provides a bond between the two elongate rings by means of the welding points alone.

U.S. Pat. No. 1,972,723 too discloses a system like that of the above FR-A-445.975, but its side members are made firmer by the inclusion of a circumferential ring.

In fact, U.S. Pat. No. 1,932,059 re-proposes the embodiments of the above FR-A-445.975 and U.S. Pat. No. 1,972,723, while U.S. Pat. No. 1,103,519 discloses the same embodiment as the above FR-A-445.975, as also do U.S. Pat. No. 1,510,750 and U.S. Pat. No. 1,710,384.

To ensure that the support will be even more secure and that the elements forming the two side members of the support or reel will be stable so that anomalous tensions are not created even with an abnormal winding tension or occasional impacts, the present applicant has studied and tested a new type of support or reel, which is also very accurately executed geometrically; this new support is particularly simple and, at the same time, rigid, and even untimely impacts, imperfect welds or anomalous winding tensions cannot cause damage which will make the support unserviceable.

In the meantime the applicant has embodied a support with a very small number of different components, and in this way even a modest quantity of supports is suitable for mehanization of the processes and offers very low costs and also a considerable saving of materials. All these advantages are obtained with a support having flat side faces without projections and therefore suitable to be boxed and enclosed in plastic insulation bags and possibly stored on pallets or platforms.

According to the invention each side member of the support is made of four elements, which pass substantially at a tangent to a central circle and, at the same time, form a part of the hub and also a chord of the outer circumference of the side member.

Such four elements, all of which have the same form and size, are mutually interlocked centrally by an interconnection which constrains one element in relation to the preceding element and to the successive element, such elements being anchored to each other terminally so as to ensure a correct and stable planar surface.

Such a form enables side members of the support or reel to be obtained which have perfectly flat outer surfaces suitable to be boxed, stored and handled on pallets.

The flat outer surfaces are important because they prevent the boxes becoming worn or broken and obviate damage to the container and, for instance, the entry of air, dirt or damp. This is particularly important when it is useful to provide good insulation against damp by covering the box or reel, for instance, with a sealed plastic bag.

In an evolutive embodiment each side surface of the support is made with four elements joined together in two pairs during formation of the support and then anchored, when assembled together, with one single welding point, thus ensuring additional stability.

The invention is therefore embodied in a support for winding packages of wire such as welding wire, copper wire, tubular elements, steel wire, etc., such support comprising two side members and spacers on which a filiform element is wound, such side members having their outer face substantially flat and each side member comprising a hub to cooperate directly with a winding machine and with a usage machine, the support being characterized in that each side member consists of at least two elements crossed over each other and interlocked at a connection point so as to form at least part of the arms of a cross.

Let us now see some preferred embodiments of the invention with the help of the attached figures, which are given as a non-restrictive example and in which.

Figure 1:
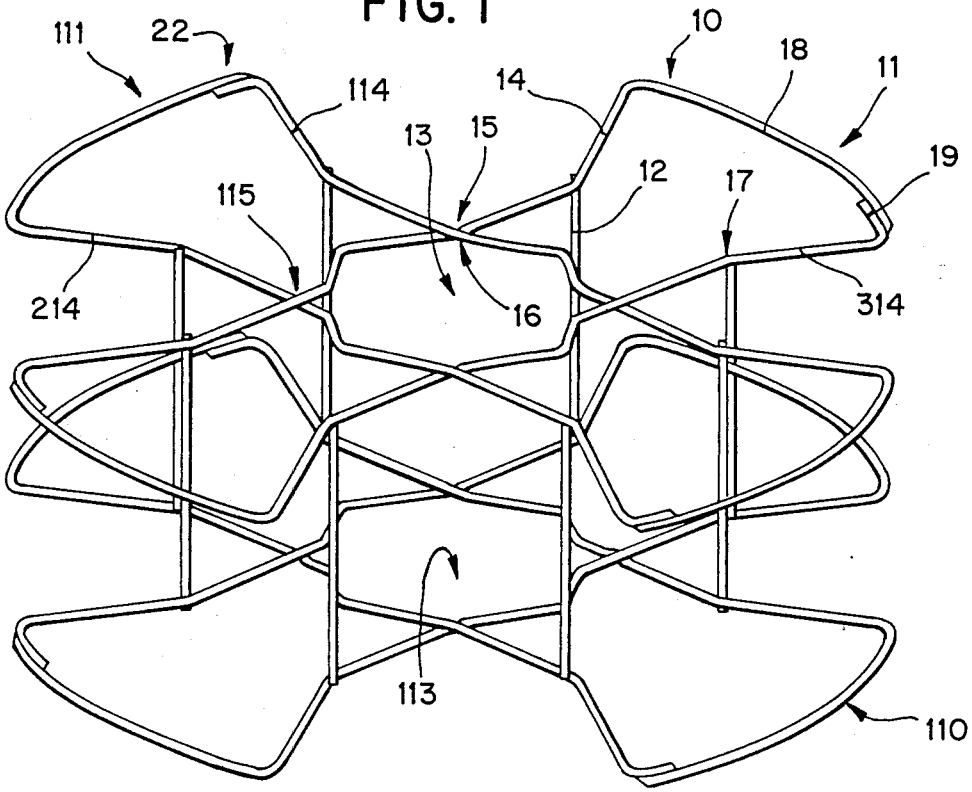
FIG. 1 shows an example of four identical elements arranged in a cross.

In FIG. 1, which is described more fully as it comprises the greater part of the innovatory features which can be transferred also to the other embodiments, a support comprises a side member 10 and another side member 110, which comprise hubs 13–113 respectively for coupling a winding machines or usage machines. Each side member is made by the union of a plurality of elements which take up substantially the form of a cross with arms 11 and 111 at a right angle to each other.

The side members 10–110 are connected together at a required distance apart by spacer elements 12 positioned at a right angle to, and anchored to, the side members 10–110; such spacers 12 form the structure onto which the wire is wound and are welded at 17 to the side members 10–110.

Such cross formed with arms 11–111 consists of filiform elements 14–114–214–314, which are completely identical to each other and are connected together by being superimposed and then welded to each other.

The connecting point shown in the figures is optional in that it can be located anywhere on the periphery of the two elements 14 which form an arm 11 or 111 of the cross.

Figure 5A:
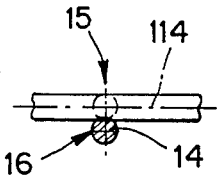
FIGS. 5 and 6 show two possible connections of intersecting elements.
Figure 5B:
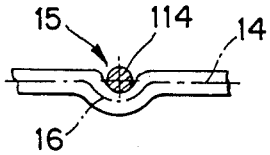
Figure 6A:
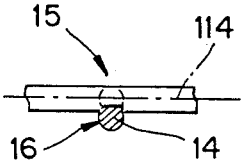
Figure 6B:
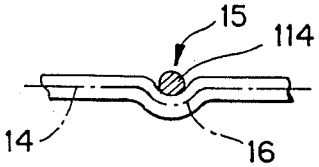

FIGS. 5 and 6 show two possible systems for obtaining the required outer flatness of the side members 10–110.

In FIG. 5 is it possible to see how the element 114 is substantially straight in the interlocking zone, whereas the element 14 comprises a shaped portion 15 able to lodge and position the element 114; a weld provides the connection. On the other hand, in the interlocking zone of FIG. 6 the element 114 remains substantially straight but includes a small reduced-diameter portion in which is lodged the element 14, which provides a contour 16 suitable for maintaining the outer superficial flatness of the side member 10 or 110.

As can be seen in the figures, if it is element 114 which has a straight development in one interlocking zone 15 while the element 14 includes the shaped portion 16, then in the next interlocking zone 115, it will be the element 14 which has a straight development whereas the element 214 comprises a shaped portion 16.

Each element 14, therefore, comprises a shaped portion 16 and a straight portion at each interlocking zone 15 with which it cooperates; in the embodiment of a cross with two arms each element 14 cooperates with two interlocking zones 15 and each side member 10 comprises four interlocking zones.

Each of the two arms 11–111 of the cross consists of two parallel elements, namely 14–314 and 114–214 respectively in the example shown.

Figure 4:
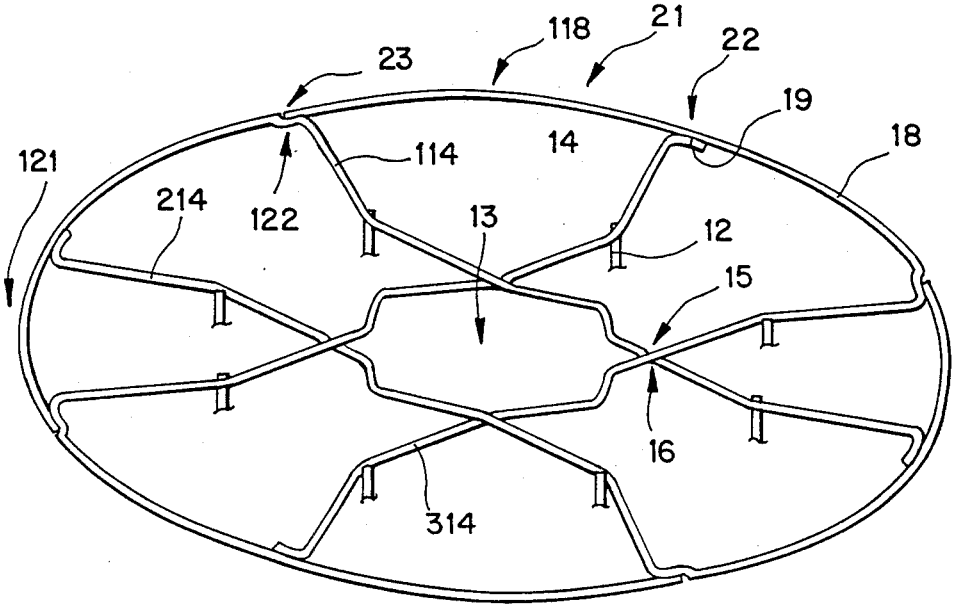
FIG. 4 shows yet another variant.

In FIG. 4 the two arms 21–121 of the cross are made by 314 with 114, 214 with 314, 14 with 214 and 114 with 14, that is to say, each element is connected to an element upstream of itself and, at its other end, to an element downstream of itself.

Figure 2:
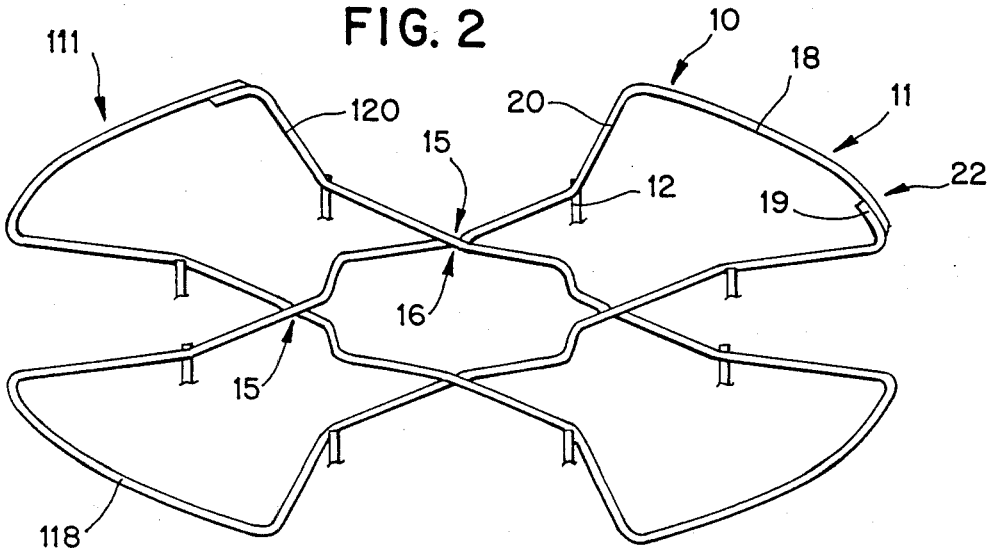
FIG. 2 shows an evolutive variant of the embodiment of FIG. 1.

In FIG. 2 the arms 11 and 111 of the cross are made by means of a continuous length 20–120 of two elements (for instance, 14 and 114) and with one single connection point 22 after the shaped lodgement.

In FIG. 4 each element comprises a circumferential extension suitable to form a continuous outer circumference.

In the embodiments shown the connection 22–122 between the elements 14 is obtained along the outer circumference but could be made at any other required point.

In the examples shown the elements 14 comprise a circumferential portion 18 at one end and a connecting portion 19 at their other end.

In the examples shown one of the portions 18–19 is oriented in the opposite direction to the other portion 19.

As the figures show, the portions 18–19 are fixed to each other by welding at 22.

The portion 19 can also lie on a plane substantially normal to the plane of the side members 10–110 and can include a loop to lodge the end zone of the portion 18.

In FIG. 2 the arms 11–111 of the cross are obtained with one single length 18 of element and one single length 19 of element, whereas in the other embodiments shown the arms of the cross are obtained with lengths 18–19 of two elements.

In FIG. 4 at the initial zone of the portion 18 a seating 23 is provided which is suitable to lodge and secure (122) the end of the portion 18, which, with the reference 118, extends beyond its arm of the cross so as to form, together with the other portions 18, the outer circumference of the side member; in FIG. 4 the portion 19 may be oriented in the same direction as the portion 18.

Fixture of the end portion 118 at 122 may be carried out by means of a lateral seating of that portion, the shaping 23 being eliminated.

Figure 3:
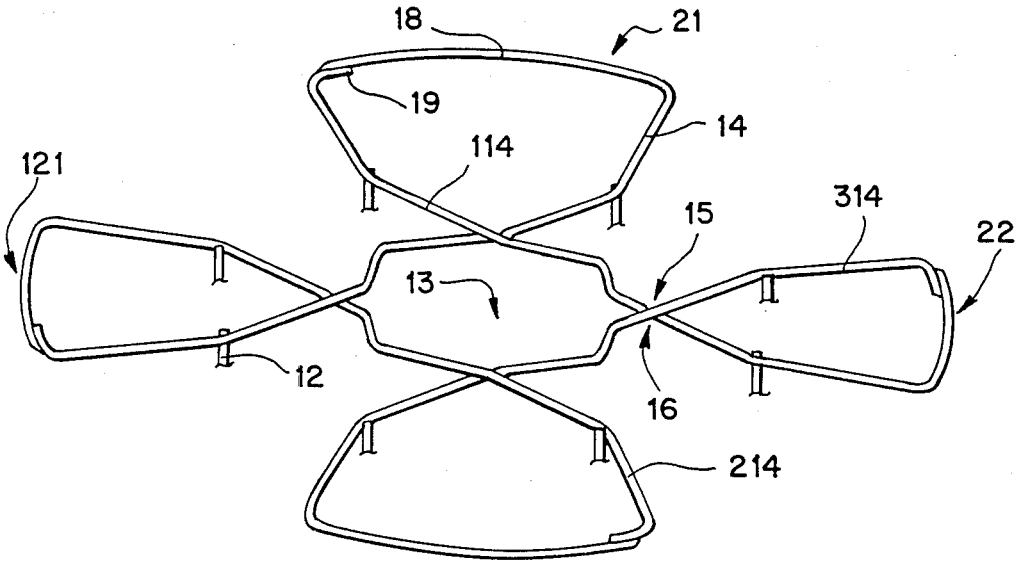
FIG. 3 shows a further variant of the embodiment of FIG. 1.

If necessary, the example of FIG. 3 too can include the end portions 118 and be embodied with an outer circumference as in FIG. 4, this being a direct variant of the embodiment of FIG. 1.

Figure 7:
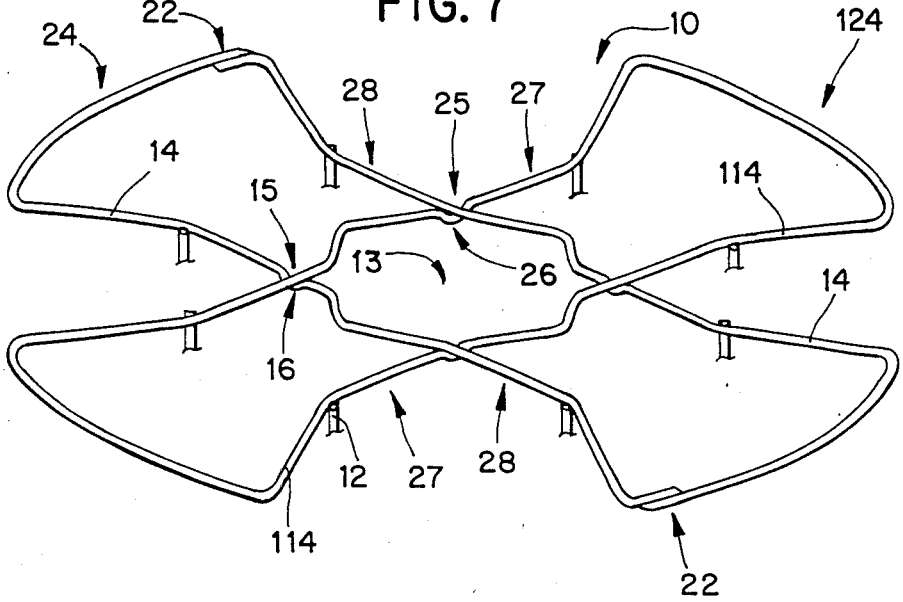
FIG. 7 shows a composite variant.

In FIG. 7 the side member 10 or 110 is obtained with only two identical elements 24–124 respectively, which in this case are interlocked at the hub at 25.

To ensure the required flatness, the invention contemplates that, of the two half hubs 27 and 28 respectively, the first is flat whereas the other comprises a shaped portion 26 to lodge the flat terminal zone of the first.

Thus, in the example shown, the half hub 27 is flat and its terminal zone is lodged in the shaped portion 26 of the other half hub 28.

The interlocking zone 15 will be embodied as said above if the side member is to be flat on one surface.

Meanwhile, the spacers 12 can be secured either to the outside or to the inside of the side members, this depending merely on the technical requirements.

I claim:

1. A support for winding packages of wire such as welding wire, copper wire, tubular elements, steel wire, etc., comprising two side members spaced apart by spacers, each of said side members being formed essentially in the shape of a cross having four arms and having a substantially flat outer face and a hub which cooperates directly with a winding machine and with a usage machine, wherein each of said side members comprises at least two elements crossed over each other and interlocked at interlocking points so as to form the arms of the cross, each of said elements comprises at least one substantially straight portion and at least one shaped portion, each of said interlocking points is located where the substantially straight portion of one member intersects the shaped portion of another member, and at each interlocking point, the straight portion is located on a same side of the side member, relative to the shaped portion.

2. A support as claimed in claim 1, wherein the substantially straight portion of each of said elements comprises a reduced-diameter portion which cooperates with the shaped portion of another member.

3. A support as claimed in claim 1, wherein each of said side members comprises two elements, each of said elements having two substantially straight portions and two shaped portions, and consisting of a single continuous element connected to itself to form two opposing arms of the cross.

4. A support as claimed in claim 1, wherein each of said side members comprises four elements, each of said elements having one substantially straight portion and one shaped portion, and crossing over two other of said elements at essentially right angles, said interlocking points being formed at points where each element crosses over another element, and wherein each of said elements forms a part of two adjacent arms of the cross.

5. A support as claimed in claim 1, wherein each of said side members comprises four at least partially parallel elements, each of said elements having one substantially straight portion and one shaped portion, and crossing over two other of said elements, wherein said interlocking points are formed at points where each element crosses over another element.

6. A support as claimed in claim 5, wherein said four elements are essentially identical and each element has a first and a second interconnection portion, and wherein the first interconnection portion of each element is connected to the second interconnection portion of another element.

7. A support as claimed in claim 6, wherein each element further has third and fourth interconnection portions, the third interconnection portion of each element being connected to the fourth interconnection portion of another element, and wherein at least two of said interconnection portions are positioned circumferentially.

8. A support as claimed in claim 5, wherein a first and a second of said four elements are interconnected to form two opposing arms of the cross and a third and a fourth of said four elements are interconnected to form the other two opposing arms of the cross, and wherein interlocking points are formed where said first and second elements cross said third and fourth elements.

9. A support as claimed in claim 8, wherein the substantially straight portion of each of said elements comprises a reduced-diameter portion which cooperates with the shaped portion of another member.

10. A support as claimed in claim 8, wherein said four elements are essentially identical and each element has a first and a second interconnection portion, and wherein the first interconnection portion of each element is connected to the second interconnection portion of another element.

11. A support as claimed in claim 10, wherein each element further has third and fourth interconnection portions, the third interconnection portion of each element being connected to the fourth interconnection portion of another element, and wherein at least two of said interconnection portions are positioned circumferentially.

* * * * *